US010224664B2

(12) United States Patent
Kitajima

(10) Patent No.: US 10,224,664 B2
(45) Date of Patent: Mar. 5, 2019

(54) BOARD CONNECTOR

(71) Applicant: Sumitomo Wiring Systems, Ltd., Yokkaichi, Mie (JP)

(72) Inventor: Mitsunori Kitajima, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/884,439

(22) Filed: Jan. 31, 2018

(65) Prior Publication Data

US 2018/0248291 A1 Aug. 30, 2018

(30) Foreign Application Priority Data

Feb. 3, 2017 (JP) ..... 2017-018164

(51) Int. Cl.
*H01R 13/41* (2006.01)
*H01R 12/71* (2011.01)

(52) U.S. Cl.
CPC ..... *H01R 13/41* (2013.01); *H01R 12/716* (2013.01)

(58) Field of Classification Search
CPC ..... H01R 12/716; H01R 13/41; H01R 9/053
See application file for complete search history.

(56) References Cited

U.S. PATENT DOCUMENTS 5,037,316 A * 8/1991 Fukushima ..... H05K 3/3426 439/79
5,263,882 A * 11/1993 Peterson ..... H01R 13/41 439/733.1
5,269,694 A * 12/1993 Kachlic ..... H01R 12/721 439/567
5,667,393 A * 9/1997 Grabbe ..... H01R 4/028 439/660
5,882,212 A * 3/1999 McHugh ..... H01R 12/716 439/660
6,217,347 B1 * 4/2001 Schell ..... H01R 12/722 439/79
6,505,402 B2 * 1/2003 Moriwake ..... H01R 43/16 264/272.11
6,971,922 B2 * 12/2005 Shimizu ..... H01R 13/20 439/682
2015/0044916 A1 * 2/2015 Beck ..... H01R 12/585 439/733.1
2015/0064987 A1 * 3/2015 Nakamura ..... H01R 12/585 439/733.1
2016/0006153 A1 * 1/2016 Tsugawa ..... H01R 13/26 439/626

FOREIGN PATENT DOCUMENTS

JP 2003-059568 2/2003

* cited by examiner

*Primary Examiner* — Briggitte R Hammond
(74) *Attorney, Agent, or Firm* — Gerald E. Hespos; Michael J. Porco; Matthew T. Hespos

(57) ABSTRACT

A board connector (10) has a tubular housing (20) that includes a back wall (25) with penetrating through holes (26). A terminal fitting (60) includes a tab (61) to be arranged to project into the housing (20) through the through hole (26), a press-fit portion (62) to be arranged inside the through hole (26) and a lead portion (63) to be arranged along a surface of a board (90). The press-fit portion (62) is inserted into the through hole (26) with an overlapping margin in a cross-section along a height direction in which the lead portion (63) faces the surface of the board (90). The tab (61) is inserted into the through hole (26) without any overlapping margin in the same cross-section.

3 Claims, 10 Drawing Sheets

BOARD CONNECTOR

BACKGROUND

Field of the Invention

The invention relates to a board connector.

Description of the Related Art

Japanese Unexamined Patent Publication No. 2003-59568 discloses a receptacle-like housing to be disposed on a printed board. The housing includes a back wall through which a mounting hole portion penetrates. A terminal fitting is mounted into the housing. The terminal fitting includes a tab to be arranged inside the housing through the mounting hole, a press-fit portion to be arranged in a press-fit state in the mounting hole and a connecting end portion to be connected to the printed board. The terminal fitting is a flat rectangle having the same cross-sectional shape in a length direction.

Dimensions of the outer surface of the above-described terminal fitting in a long side direction and a short side direction are equal to dimensions of the inner surface of the mounting hole in the long side direction and the short side direction. Thus, the tab scrapes a wall surface of the back wall in passing through the mounting hole and there has been a concern for the occurrence of an electrical trouble due to of scraped resin dregs on the printed board or the like.

The dimensions of the outer surface of the terminal fitting in the long side and short side direction could be made smaller than the dimensions of the inner surface of the mounting hole in the long side and the short side direction to reduce a production of resin dregs when the tab passes. However, a press-fitting margin of the press-fit portion to the mounting hole is reduced. Further, in a surface mounting type in which the connecting end contacts a surface of the printed board, if the position of the press-fit portion in the mounting hole portion is not determined, the height of the connecting end portion with respect to the board varies. Thus, so-called coplanarity cannot be ensured.

The invention was completed on the basis of the above situation and aims to improve the quality of a board connector.

SUMMARY

The invention is directed to a board connector to be disposed on a board. The board connector includes a tubular housing including a back wall with a penetrating through hole. The connector also includes a terminal fitting with a tab to project into the housing through the through hole. The terminal fitting also has a press-fit portion to be arranged inside the through hole and a lead portion to be arranged along a surface of the board. The tab, the press-fit portion and the lead portion are provided successively one after another. The press-fit portion is inserted into the through hole with an overlapping margin in a cross-section along a height direction in which the lead portion faces the surface of the board. The tab is set to be inserted into the through hole without any overlapping margin in the cross-section.

The press-fit portion is inserted into the through hole with the overlapping margin in the cross-section along the height direction in which the lead portion faces the surface of the board. Thus, a height variation of the lead portion is suppressed and coplanarity with the board is ensured. Further, the tab is inserted into the through hole without any overlapping margin in the same cross-section. Thus, a situation where the tab scrapes the inner surface of the press-fit portion is avoided and resin dregs are not produced. As a result, the quality of the board connector including the terminal fitting to be mounted on the surface of the board is improved.

An inner surface of the through hole may have two first surfaces facing each other and two second surfaces perpendicular to the first surfaces and facing each other in the cross-section. Each first surface may have a recess retracted from a contact area of the tab to be held in contact with a mating terminal fitting at a position separated from inner corners to the second surfaces, and chamfers retracted from the inner corners may be provided on outer corners on both sides across the contact area on an outer surface of the tab. When the tab passes through the through hole, the contact of the contact area of the tab with the inner surface of the through hole can be avoided by the recess of the first surface. Thus, connection reliability between the terminal fitting and the mating terminal fitting can be ensured. On the other hand, if the recess is present on the first surface of the through hole, there is a higher possibility that the outer corners of the tab contact the inner corners of the first surface to produce resin dregs. However, since the chamfers are provided on the outer corners of the tab, the contact of the outer corners of the tab with the inner corners of the first surface can be avoided and the production of resin dregs is prevented more reliably.

The press-fit portion may include cuts continuous with the chamfers, and clearances may be formed between the cuts and the inner surface of the through hole. When the press-fit portion is inserted into the through hole with the overlapping margin, resin dregs scraped by the press-fit portion may be pushed toward the housing. However, the resin dregs can be collected inside the cuts according to the above configuration, and are pushed out into the housing. In addition, since the cuts are continuous with the chamfers, the cuts and the chamfers can be processed simultaneously and manufacturing facility can be ensured.

DETAILED DESCRIPTION

Figure 1:
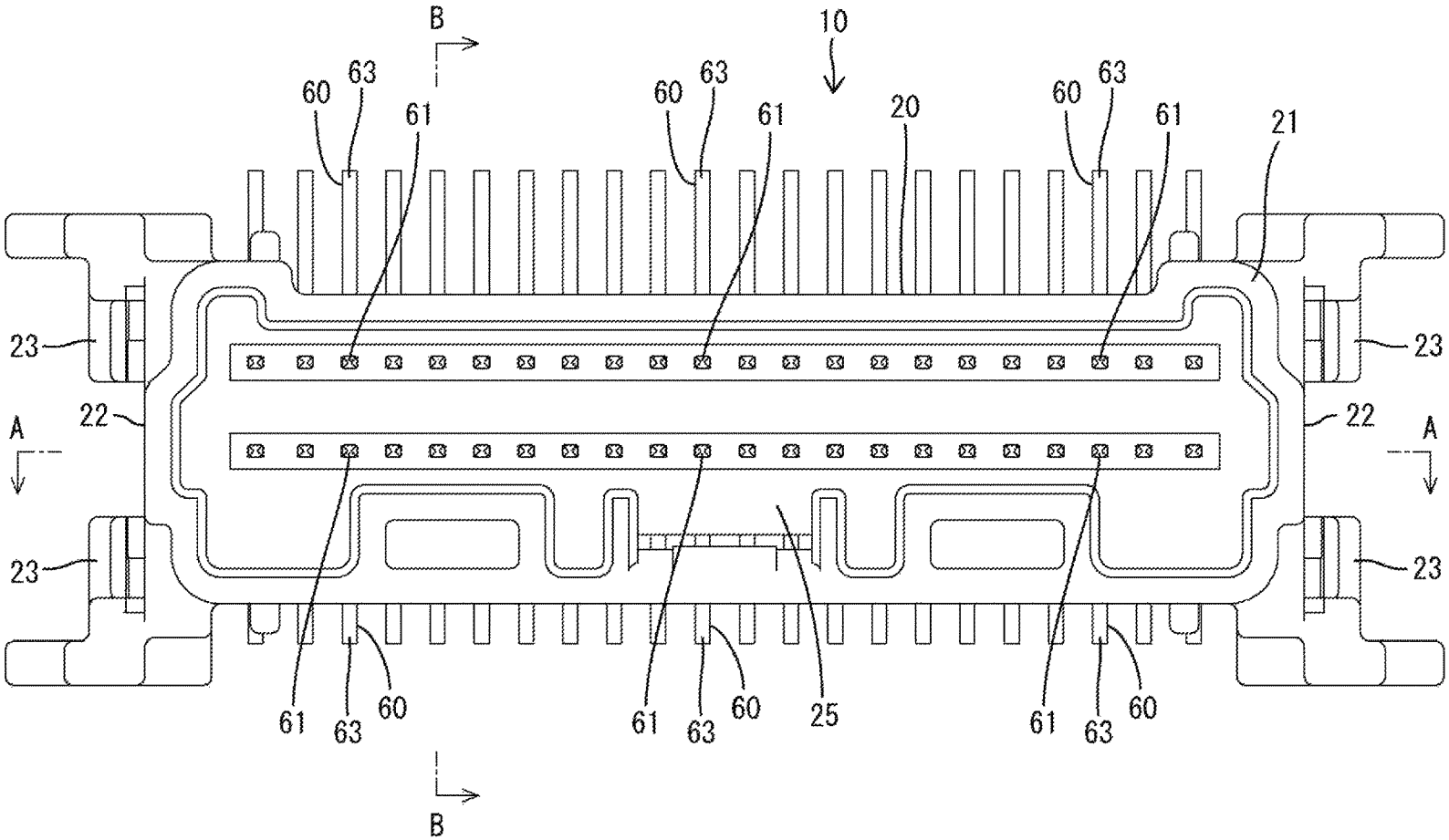
FIG. 1 is a plan view of a board connector according to one embodiment of the present invention.

One embodiment is described with reference to the drawings. A board connector 10 according to the embodiment includes a housing 20 made of synthetic resin and terminal fittings 60 made of electrically conductive metal and to be mounted into the housing 20. The housing 20 is disposed on a printed circuit board 90 and connectable to an unillustrated mating housing. In this embodiment, a vertical connector is illustrated and is disposed on the board 90 with a connection surface of the housing 20 to the mating housing facing up (direction perpendicular to a direction of a surface of the board 90). Note that a vertical direction in the description is based on a state where the housing 20 is disposed on the board 90.

Figure 3:
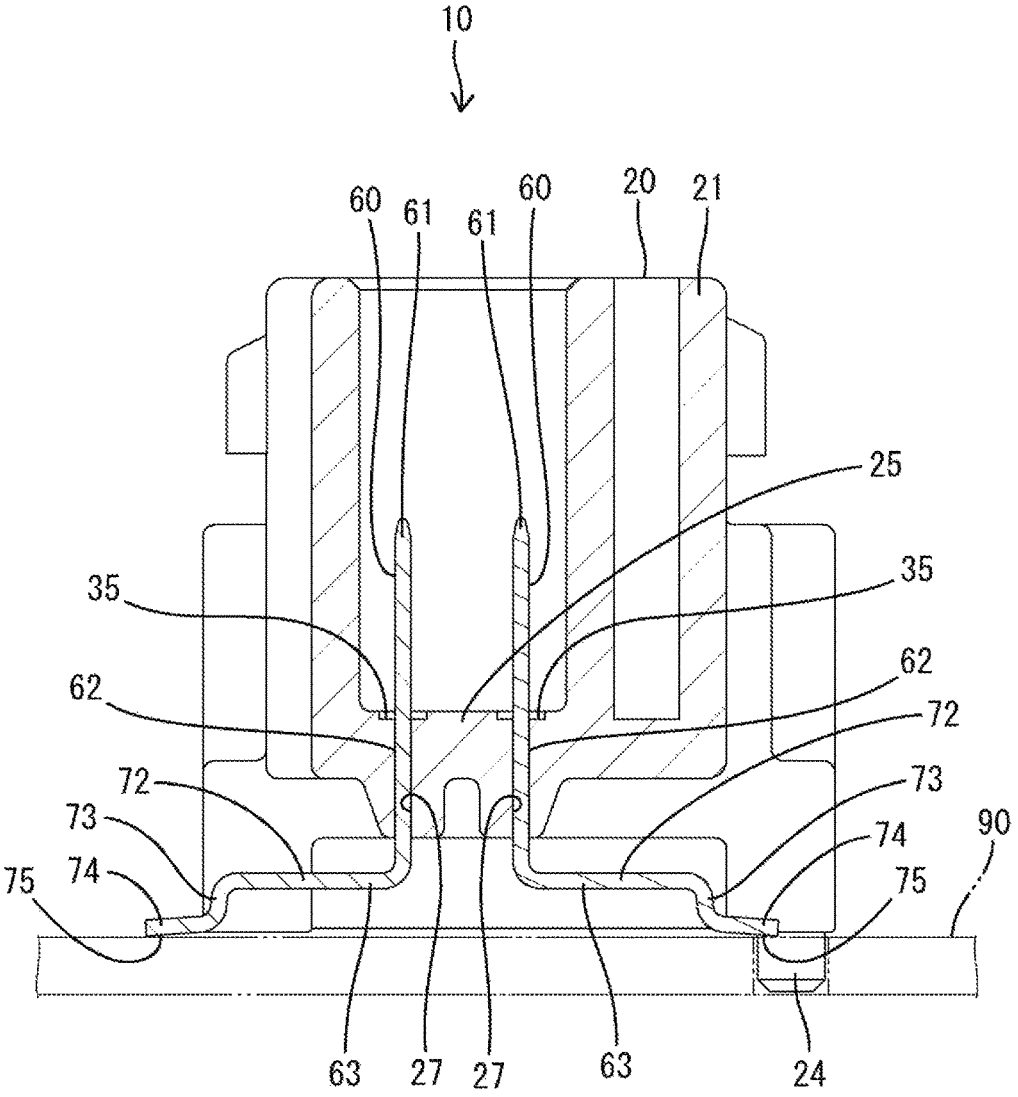
FIG. 3 is a section along B-B of FIG. 1.
Figure 4:
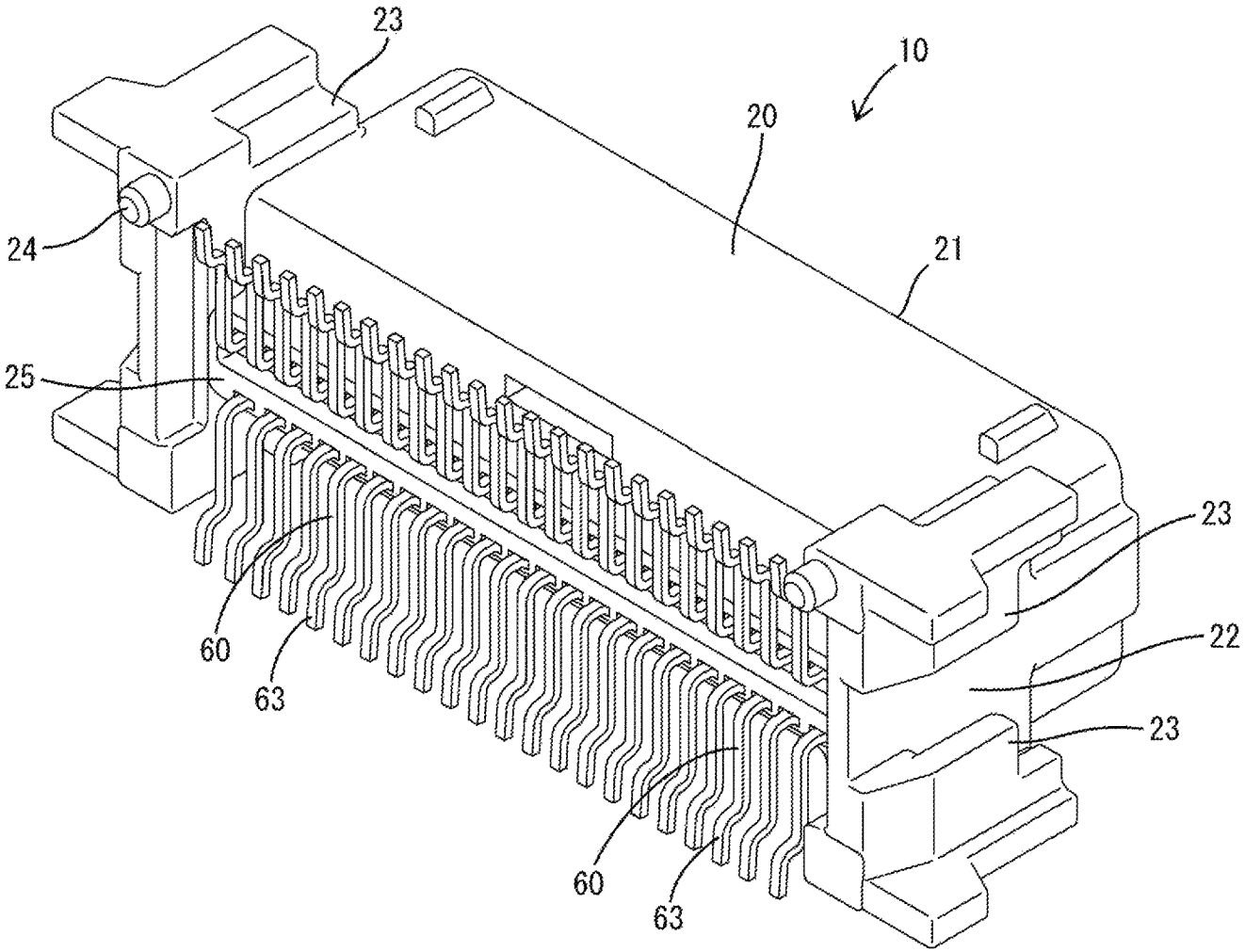
FIG. 4 is a perspective view of the board connector.
Figure 5:
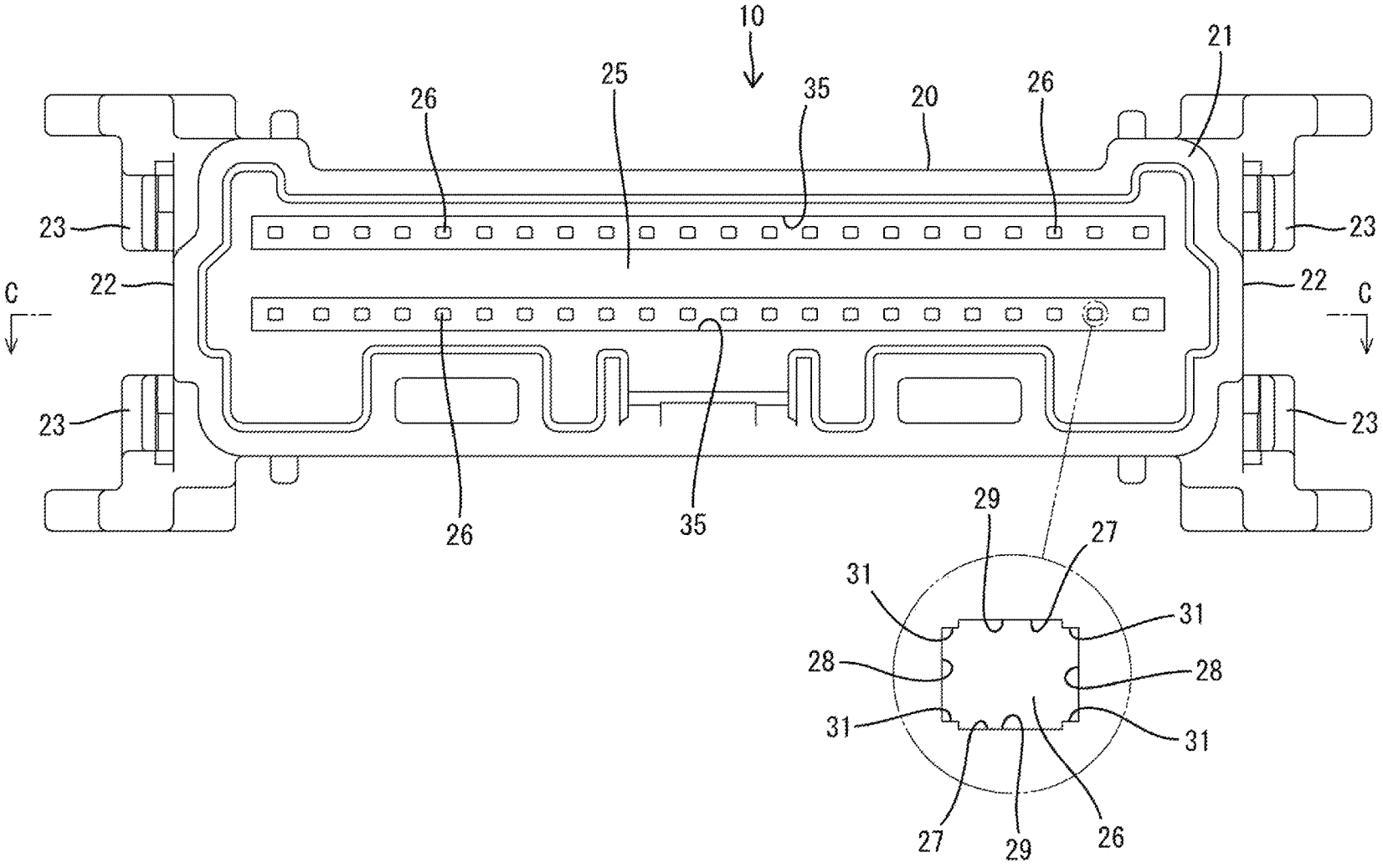
FIG. 5 is a plan view of a housing.
Figure 6:
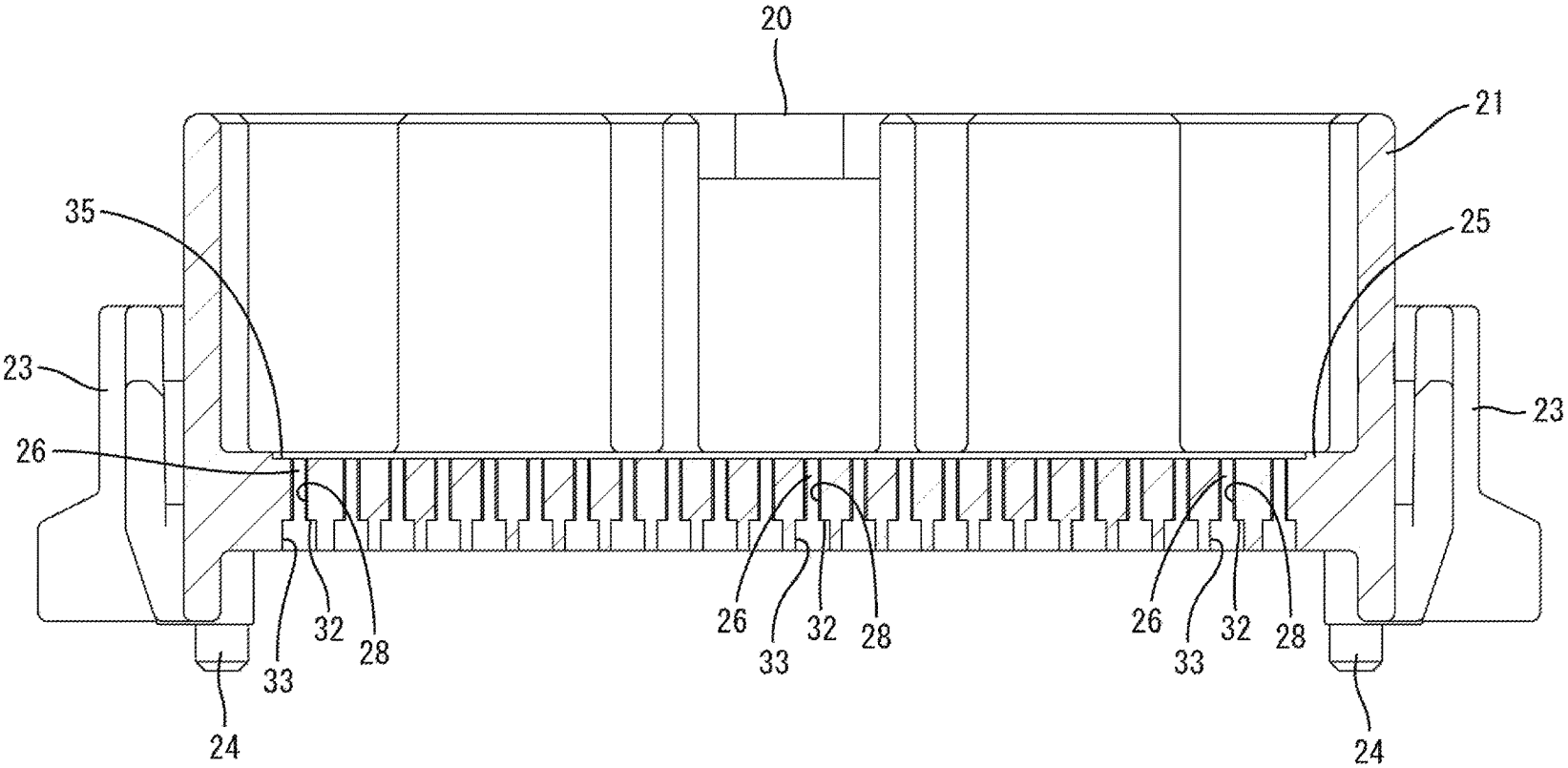
FIG. 6 is a section along C-C of FIG. 5.
Figure 7:
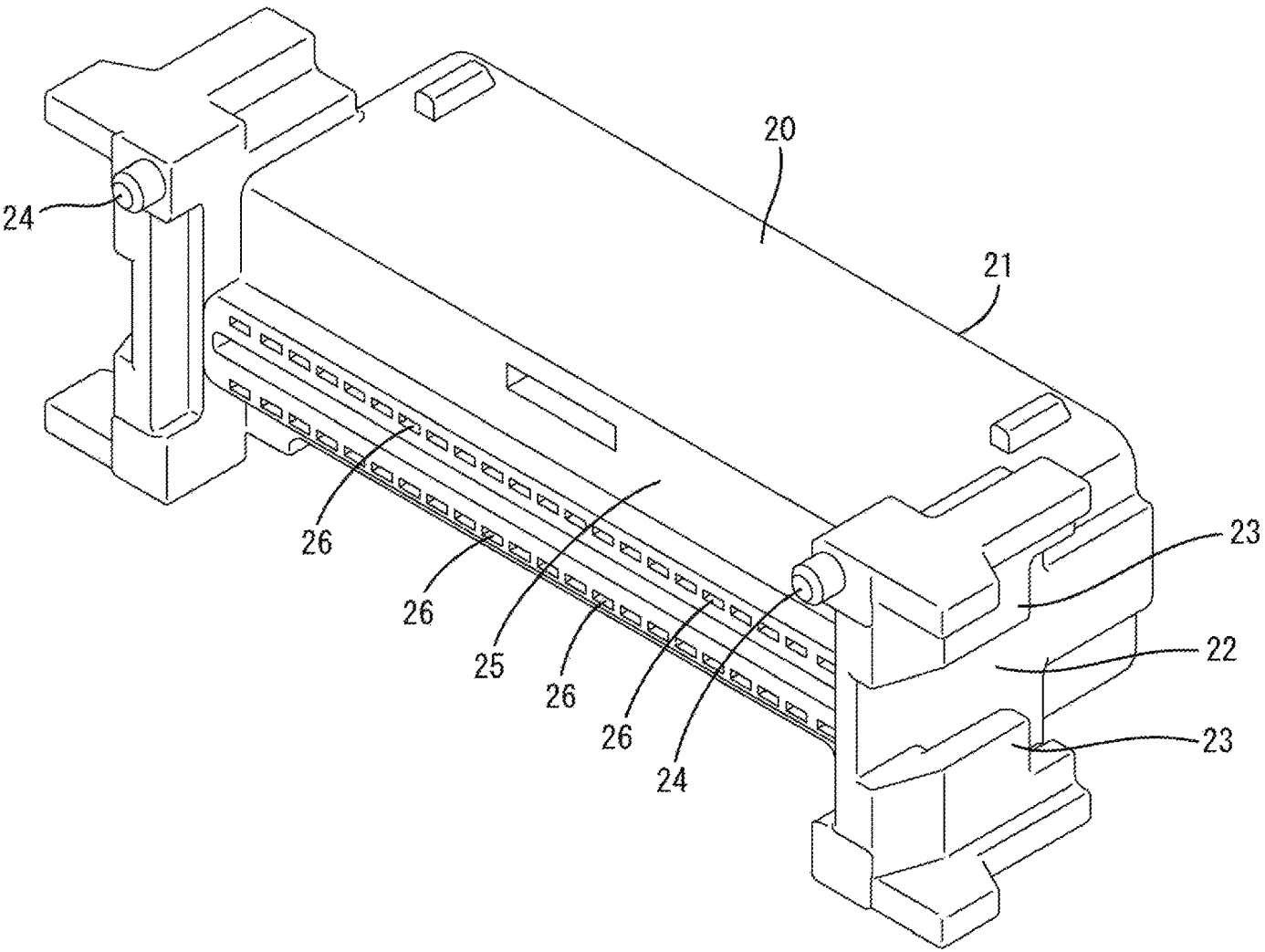
FIG. 7 is a perspective view of the housing.

As shown in FIGS. 5 and 6, the housing 20 has a receptacle 21 in the form of a rectangular tube extending long in a lateral direction and open upward. Mounting grooves 22 are provided in the outer surfaces of both left and right end parts of the receptacle 21. Each mounting groove 22 is defined between front and rear ribs 23 extending in the vertical direction. Unillustrated fixing members made of metal are press-fit and mounted into the mounting grooves 22. The fixing members are connected to the surface of the board 90 by soldering and the receptacle 21 is fixed to the board 90 via the fixing members. Cylindrical positioning protrusions 24 are provided on left and right sides of a rear part of the lower surface of the receptacle 21. As shown in FIG. 3, the housing 20 is positioned on the board 90 by the positioning protrusions 24.

A lower part of the receptacle 21 is closed by a back wall 25. The back wall 25 is arranged to face the surface of the board 90 with a substantially constant spacing defined therebetween. As shown in FIG. 6, through holes 26 penetrate through the back wall 25 in the vertical direction (wall thickness direction). As shown in FIG. 5, a multitude of through holes 26 are aligned and arranged in the lateral direction in front and rear rows. Front and rear recesses 35 extending in the lateral direction are provided in the upper surface (inner surface) of the back wall 25, and the respective through holes 26 in each row are collectively open in the back surface of the recess 35.

Figure 9:
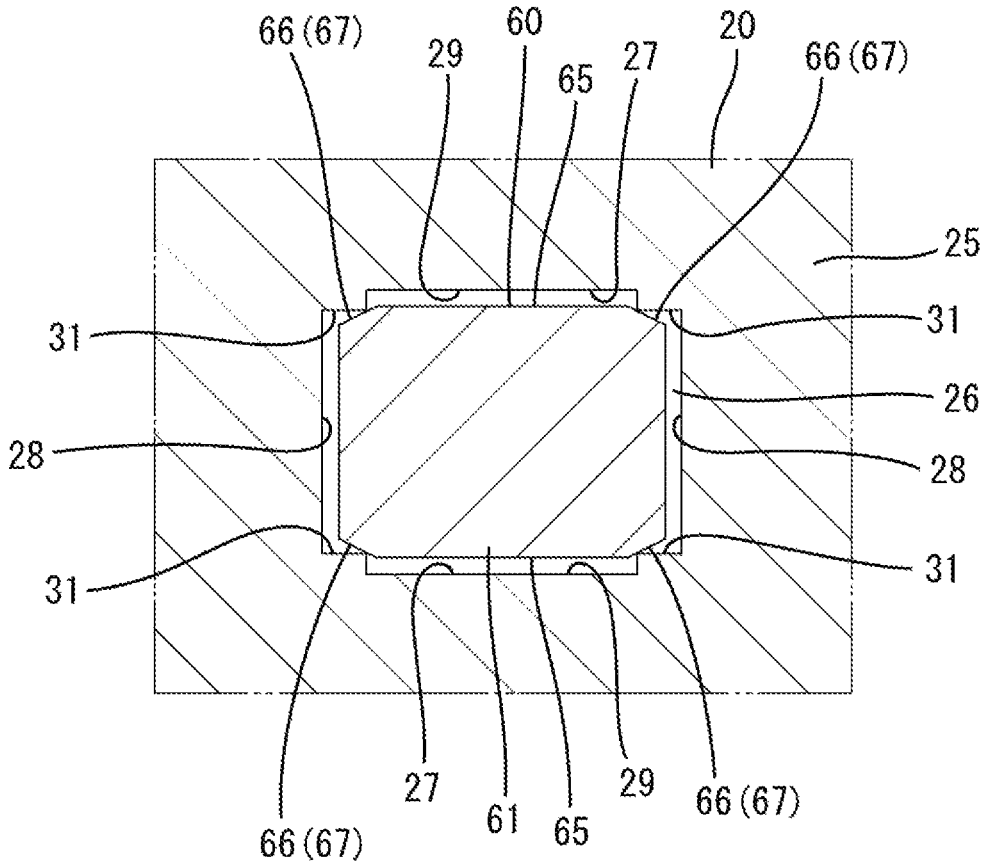
FIG. 9 is a section showing a state where a tab portion is passed through a through hole.

The terminal fitting 60 is inserted into the through hole 26 from below (side where the board 90 is located). A cross-sectional shape of each through hole 26 along a direction perpendicular to an inserting direction of the terminal fitting 60 is substantially a rectangle long in the lateral direction and, as shown in FIGS. 5 and 9, each through hole 26 is defined by two first surfaces 27 facing parallel to each other on both front and rear sides and two second surfaces 28 facing parallel to each other on both left and right sides. The first surfaces 27 are long sides longer than the second surfaces 28 and include recesses 29 by having laterally central parts cut. Each recess 29 is provided on a part of the first surface 27 of the through hole 26, open in the inner surface of the back wall 25 and faces the inside of the receptacle 21. Parts of the first surfaces 27 at both left and right sides of the recesses 29 are defined by right-angled inner corners 31 on four corners of the through hole 26.

As shown in FIG. 6, each through hole 26 includes steps 32 at intermediate positions of the second surfaces 28 in the vertical direction, specifically at positions near a lower part, and a side of the through hole 26 below the steps 32 serves as an expanded portion 33 laterally more expanded than a side of the through hole 26 above the steps 32. The expanded portion 33 is open in the lower surface (outer surface) of the back wall 25.

Figure 8:
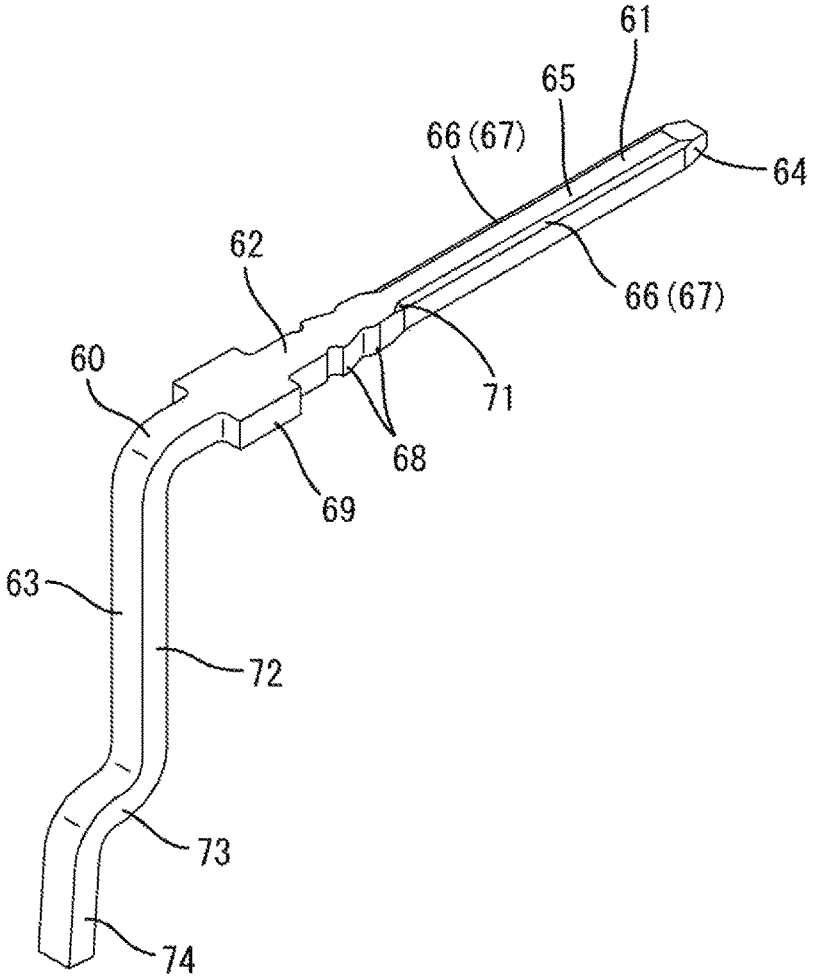
FIG. 8 is a perspective view of a terminal fitting.

The terminal fitting 60 is formed by applying bending and the like to an electrically conductive metal plate stamped into a predetermined shape. As shown in FIG. 8, the terminal fitting 60 is formed such that a tab 61, a press-fit portion 62 and a lead portion 63 are successively connected from an upper side to a lower side. A cross-sectional shape (cross-sectional shape along a direction perpendicular to the inserting direction into the through hole 26) of the terminal fitting 60 is a substantially rectangular shape long in the lateral direction.

The tab 61 is long and narrow along the vertical direction and projects into the receptacle 21 through the through hole 26. Inclined guide faces 64 are provided on four surfaces of an upper end part of the tab 61 to taper the upper end part. At the time of connecting the both housings, the tab 61 is inserted into a box of an unillustrated mating terminal fitting to be connected electrically while being guided by the guide faces 64. Laterally central parts of front and rear surfaces of the tab 61 serve as contact areas 65 to be contacted by connecting parts of the mating terminal fitting.

Four corners of the tab 61 serve as outer corners 66 located on both left and right sides across the contact areas 65, and chamfers 67 are provided on these outer corner portions 66. As shown in FIG. 9, the chamfers 67 are formed by obliquely cutting off the four corners of the tab 61 and are formed at a constant angle of inclination in areas excluding tips of the guide faces 64 in a length direction of the tab 61. The terminal fitting 60 is configured to have a constant plate thickness in the length direction except at the chamfers 67 and the guide faces 64.

A lateral dimension of the outer shape of the tab 61 is smaller than a lateral separation dimension between the second surface portions 28 of the corresponding through hole 26, and a dimension thereof in a front-rear direction is also smaller than a separation dimension in the front-rear direction between the first surfaces 27 of the corresponding through hole 26 because the chamfers 67 are separated from the inner corners 31.

Figure 2:
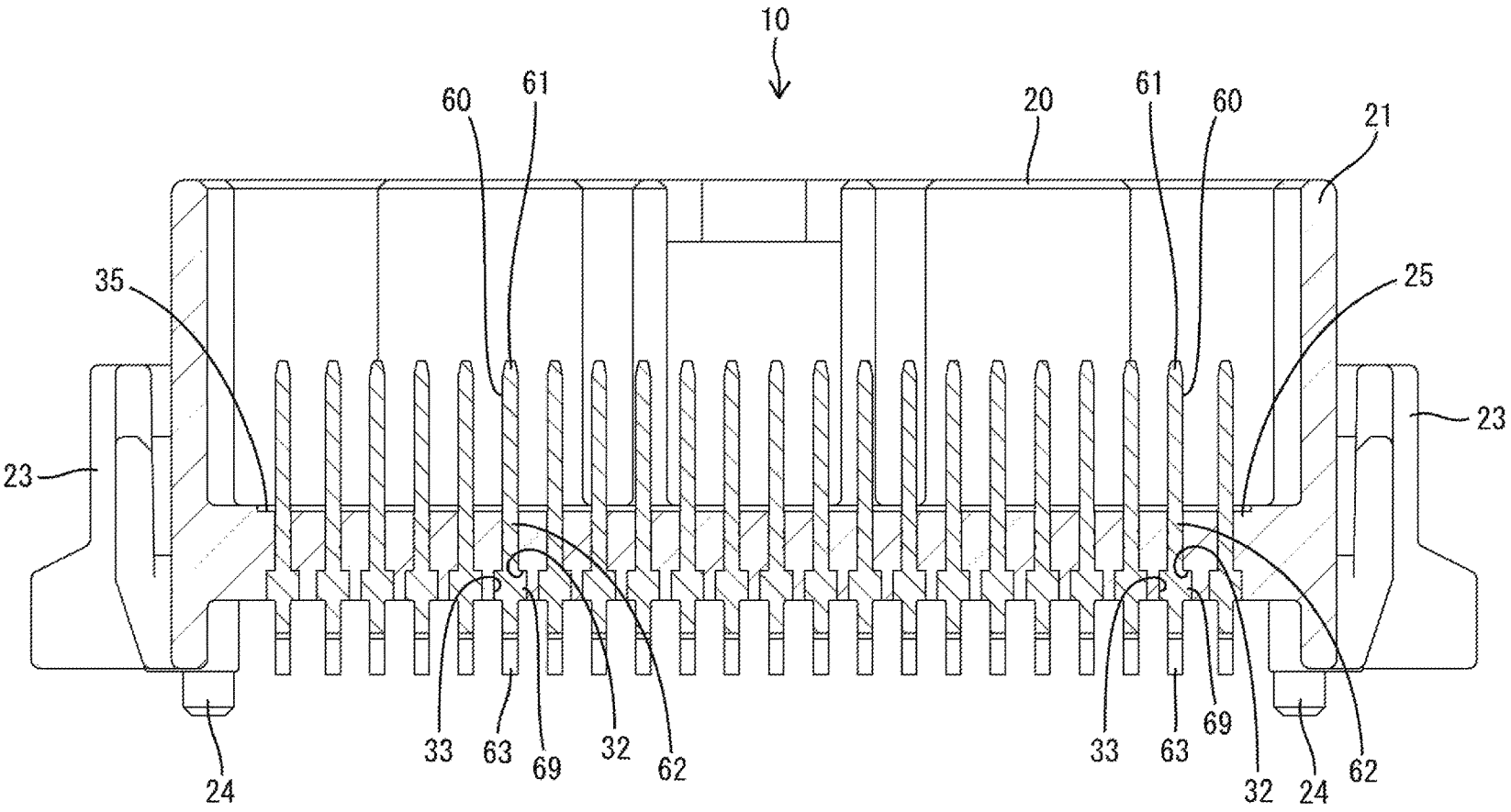
FIG. 2 is a section along A-A of FIG. 1.

The press-fit portion 62 has front and rear surfaces continuous with the front and rear surfaces of the tab 61 on the same planes and, on the other hand, is expanded more laterally than the tab 61 as a whole. Upper and lower step-like projections 68 protrude laterally on each of left and right sides on an upper part of the press-fit portion 62. Each projection 68 bites into the second surface 28 of the through hole 26 to be locked. Wings 69 protrude laterally on a lower part of the press-fit portion 62 and are rectangular in a front view. The wings 69 protrude more laterally than the projections 68 and fit into the expanded portions 33 of the through hole 26 to butt against the steps 32, as shown in FIG. 2.

The press-fit portion 62 has cuts 71 on upper four corners. The cuts 71 are formed to be continuous with the chamfers 67 by obliquely cutting off four corners of the press-fit portion 62, and gradually narrowed from upper ends connected to the chamfers 67 toward lower sides. Further, the cuts 71 are inclined to laterally expand from the upper ends connected to the chamfers 67 toward the lower sides because the press-fit portion 62 is entirely expanded.

A lateral dimension of the outer shape of the press-fit portion 62 is larger than the lateral separation dimension between the second surface portions 28 of the corresponding through holes 26 due to the presence of the projections 68 and the wings 69 and a dimension in the front-rear direction of the outer shape of the press-fit portion 62 is also larger than the separation dimension in the front-rear direction between the first surface portions 27 (here, inner corners 31) of the corresponding through hole 26 due to the absence of the chamfers 67 unlike the tab 61.

As shown in FIG. 3, the lead portion 63 is connected substantially at a right angle to the lower part of the press-fit portion 62 and includes a first extending portion 72 extending either forward or rearward, a hanging portion 73 hanging down from an extending end part of the first extending portion 72 and a second extending portion 74 extending in the same direction as an extending direction of the first extending portion 72 from the lower end of the hanging portion 73. The first extending portion 72, the hanging portion 73 and the second extending portion 74 have substantially the same cross-sectional shape in the length direction and slightly larger outer shape dimensions than the tab 61 in the front-rear direction and lateral direction. The second extending portion 74 is shorter than the first extending portion 72 and arranged slightly obliquely to the front-rear direction in a natural state. The second extending portion 74 has a connection surface 75 on the lower surface, and the connection surface 75 faces the surface of the board 90, has solder attached thereto and is designed to adjust coplanarity with the surface of the board 90.

Next, the functions of the board connector 10 of this embodiment are described.

In assembling, the terminal fitting 60 is inserted into the through hole 26 of the back wall 25 from behind. At this time, the tab 61 is inserted first into the through hole 26 and, after the tab 61 is passed through the through hole 26, the press-fit portion 62 is inserted into the through hole 26. As shown in FIG. 3, the lead portion 63 is arranged to be exposed in a space below the receptacle 21 without being inserted into the through hole 26. When the housing 20 is placed on the upper surface of the board 90, the second extending portions 74 of the lead portions 63 are arranged along the surface of the board 90 and contact unillustrated conductive paths of the board 90. Thereafter, paste solder on the board 90 adheres to the connection surfaces 75 of the second extending portions 74 and the terminal fittings 60 are connected electrically to the conductive paths of the board 90 via the lead portions 63.

The tab 61 is set to have no overlapping margin with the through hole 26 in a cross-section along a height direction in which the second extending portion 74 of the lead portion 63 faces the board 90, i.e. the cross-section shown in FIG. 3. Although arranged at positions facing the inner corners 31 of the through hole 26, the outer corners 66 of the tab 61 are retracted as the chamfers 67 from the inner corners 31. Further, the tab 61 has no overlapping margin with the through hole 26 also in a cross-section along a direction perpendicular to the cross-section along the height direction in which the second extending portion 74 of the lead portion 63 faces the board 90. Thus, as shown in FIG. 9, the contact of the tab 61 with the inner surface of the through hole 26 is avoided and a situation can be prevented where the inner surface of the through hole 26 is scraped by the tab 61 and resin dregs are produced. Particularly, since the contact areas 65 of the tab 61 are arranged at positions facing the recesses 29 of the through hole 26 and separated from the inner surface of the through hole 26 by a distance corresponding to the recessed amount of the recesses 29, a situation where the contact areas 65 contact the inner surface of the through hole 26 can be avoided more reliably.

On the other hand, the press-fit portion 62 has an overlapping margin with the through hole 26 in the same cross-section along the height direction in which the second extending portion 74 of the lead portion 63 faces the board 90 (cross-section shown in FIG. 3). Thus, the press-fit portion 62 is held in a press-fit state in the through hole 26 and the position of the press-fit portion 62 in the front-rear direction in the through hole 26 is determined. As a result, a variation in the height of the lead portion 63 continuous with the press-fit portion 62 is suppressed, a distance between the facing surfaces of the second extending portion 74 and the board 90 can be determined to be a predetermined value and coplanarity with the board 90 can be ensured.

Figure 10:
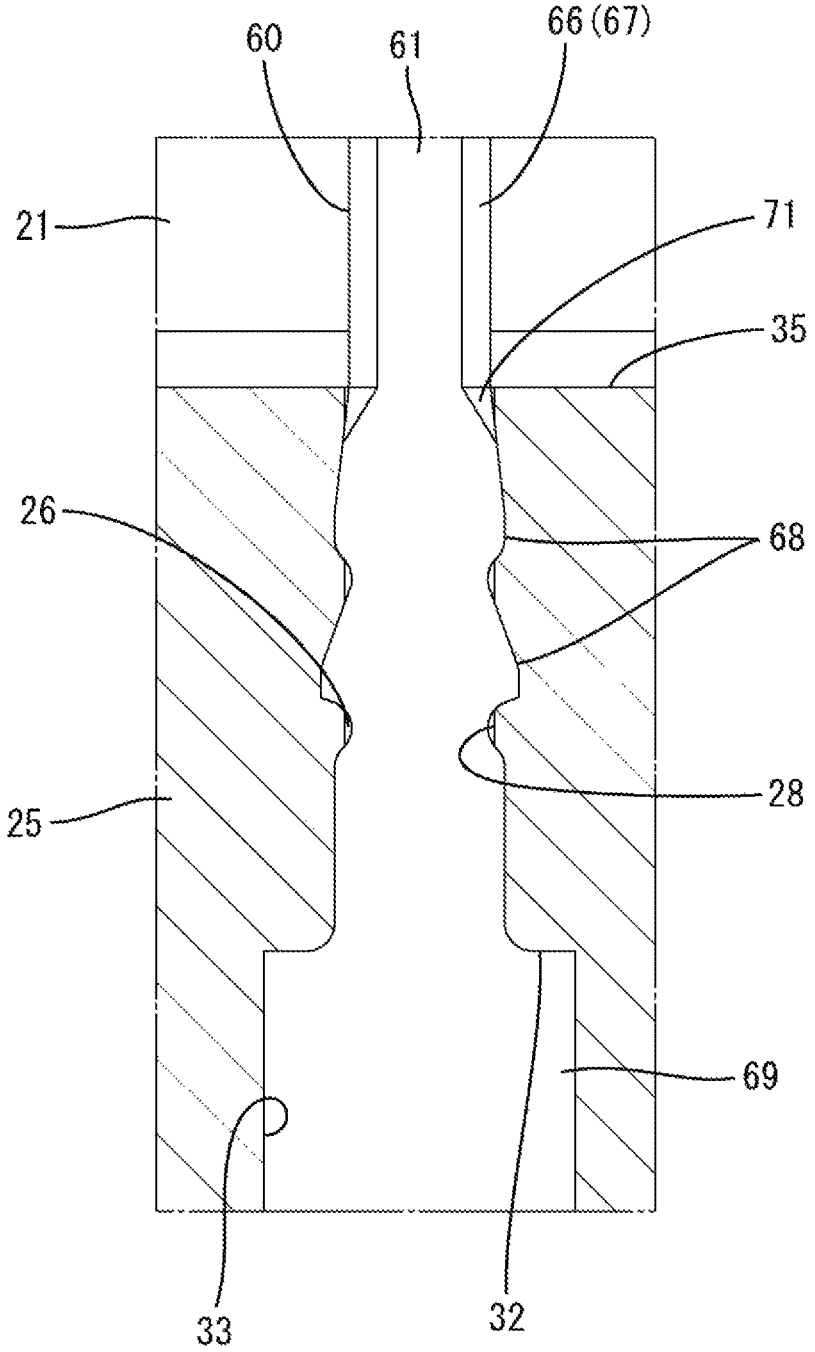
FIG. 10 is a section showing a state where a press-fit portion is inserted in the through hole.

Further, the press-fit portion 62 is set to have an overlapping margin with the through hole 26 also in a cross-section along a direction perpendicular to the cross-section along the height direction in which the second extending portion 74 of the lead portion 63 faces the board 90 (see FIG. 10). Further, in this cross-section, the projections 68 bite into the inner surface of the through hole 26 and the wings 69 are fit into the expanded portion 33 to butt against the step portions 32. As a result, the terminal fitting 60 is positioned firmly and held in the through hole 26 of the back wall portion 25.

As shown in FIG. 10, when the press-fit portion 62 is inserted into the through hole 26 of the back wall 25, the cut portions 71 provided on the upper end part of the press-fit portion 62 face the inside of the receptacle 21 and are arranged with clearances formed between the cut portions 71 and the inner surface of the through hole 26. Thus, even if the press-fit portion 62 scrapes the inner surface of the through hole 26 and resin dregs are produced in an inserting process, the produced resin dregs are collected and trapped in the clearances formed between the inner surface of the through hole 26 and the cuts 71. Therefore, resin dregs are not pushed out into the receptacle 21.

As described above, the press-fit portion 62 is inserted into the through hole with the overlapping margin 26 in the cross-section along the height direction in which the second extending portion 74 of the lead portion 63 faces the surface of the board 90, whereas the tab 61 is set to be inserted into the through hole 26 without any overlapping margin. Thus, coplanarity between the terminal fitting 60 and the board 90 can be ensured and the production of resin dregs can be prevented. As a result, the quality of the board connector 10 of the surface mounting type as in this embodiment can be improved.

Further, the inner surface of the through hole 26 has the two first surfaces 27 facing each other and the two second surfaces 28 perpendicular to the first surfaces 27 and facing each other in the cross-section, and the first surfaces 27 are provided with the recesses 29 retracted from the contact areas 65 of the tab 61 at positions separated from the inner corners 31 to the second surfaces 28. Thus, a possibility that resin dregs adhere to or scratch the contact areas 61 of the tab 61 can be reduced and connection reliability between the terminal fitting 60 and the mating terminal fitting can be ensured. Further, since the chamfers 67 retracted from the inner corners 31 are provided on the both outer corners 66 on both sides across the contact areas 65 on the outer surface of the tab 61, the production of resin dregs can be prevented more reliably.

Further, since the press-fit portion 62 includes the cuts 71 continuous with the chamfers 67 and the clearances are formed between the cuts 71 and the inner surface of the through hole 26, it can be avoided that resin dregs are pushed out into the receptacle 21. In addition, since the cuts 71 are continuous with the chamfers 67, the cuts 71 and the chamfers 67 can be processed simultaneously and manufacturing facility can be ensured.

Although the vertical connector configured such that the connecting direction of the housing is perpendicular to the surface of the board is illustrated in the above embodiment, the present invention is also applicable to a horizontal connector configured such that a connecting direction of a housing is horizontal to a surface of a board. Also in the case of the horizontal connector, a press-fit portion is inserted into a through hole with an overlapping margin and a tab portion is set to be inserted into the through hole without any overlapping margin in a cross-section along a height direction in which a lead portion faces the surface of the board.

The terminal fitting may be inserted into the through hole from the inside of the receptacle, which is an upper side in the above embodiment.

LIST OF REFERENCE SIGNS

10 . . . board connector
20 . . . housing

21 . . . receptacle
25 . . . back wall
26 . . . through hole
27 . . . first surface
28 . . . second surface
29 . . . recess
31 . . . inner corner
60 . . . terminal fitting
61 . . . tab
62 . . . press-fit portion
63 . . . lead portion
66 . . . outer corner
67 . . . chamfer
71 . . . cut
90 . . . board

What is claimed is:

1. A board connector (10) to be disposed on a board (90), comprising:

a tubular housing including a back wall with a penetrating through hole, an interior of the through hole being composed of two first surfaces facing each other and two second surfaces perpendicular to the first surfaces and facing each other in a cross-section, each of the first surfaces being provided with a recess to be retracted at a position separated from inner corners to the second surfaces;

a terminal fitting including a tab arranged to project into the housing through the through hole, a press-fit portion arranged inside the through hole and a lead portion to be arranged along a surface of the board, the tab, the press-fit portion and the lead portion being successively provided one after another; wherein:

the press-fit portion is inserted into the through hole with an overlapping margin in a cross-section along a height direction in which the lead portion faces the surface of the board;

the tab is set to be inserted into the through hole without any overlapping margin in the cross-section; and chamfers are provided on outer corners of the tab at both sides across a contact area of the tab, the chamfers being retracted from the inner corners to the second surfaces.

2. The board connector of claim 1, wherein the press-fit portion (62) includes cuts (71) continuous with the chamfers (67), and clearances are formed between the cuts (71) and the inner surface of the through hole (26).

3. A board connector, comprising:

a terminal fitting including a front end, a tab extending rearward from the front end, the tab having two opposed first outer surfaces, two opposed second outer surfaces aligned orthogonal to the first outer surfaces, and chamfers extending along the tab between the first and second outer surfaces of the tab, a press-fit portion rearward of the tab and including cuts continuous with the chamfers, and a lead portion rearward of the press-fit portion; and a tubular housing made of resin and including a back wall with a penetrating through hole, an interior of the through hole having two opposed first inner surfaces, two opposed second inner surfaces perpendicular to the first surfaces and convex corners between the first inner surfaces and the first outer surfaces, wherein:

the tab is insertable through the through hole with the first and second outer surfaces of the tab spaced inward from the first and second inner surfaces of the through hole;

the press-fit portion is press fit into the through hole with an overlapping margin in a cross-section along an inserting direction; and the cuts of the press-fit portion are spaced inward from the inner surfaces of the through hole to define clearances for receiving any dregs of resin generated during insertion of the tab into and through the through hole.

* * * * *